US008251174B2

(12) United States Patent
Welch et al.

(10) Patent No.: US 8,251,174 B2
(45) Date of Patent: Aug. 28, 2012

(54) METHOD FOR BONDING HONEYCOMB CORES

(75) Inventors: John M. Welch, Wichita, KS (US); John Thomas Strunk, Derby, KS (US); Brian R. Kitt, Wichita, KS (US)

(73) Assignee: Spirit AeroSystems, Inc., Wichita, KS (US)

( * ) Notice: Subject to any disclaimer, the term of this patent is extended or adjusted under 35 U.S.C. 154(b) by 0 days.

(21) Appl. No.: 12/732,415

(22) Filed: Mar. 26, 2010

(65) Prior Publication Data

US 2011/0232991 A1 Sep. 29, 2011

(51) Int. Cl.
*E04B 1/82* (2006.01)

(52) U.S. Cl. ..... 181/292; 181/210

(58) Field of Classification Search ..... 181/210, 181/213, 214, 292

See application file for complete search history.

(56) References Cited

U.S. PATENT DOCUMENTS 4,265,688 A * 5/1981 Gorski ..... 156/73.1
5,476,237 A * 12/1995 Clarke ..... 244/110 B
5,558,919 A * 9/1996 Toni et al. ..... 428/116
5,581,054 A * 12/1996 Anderson et al. ..... 181/213
5,688,353 A * 11/1997 Dublinski et al. ..... 156/256
5,776,579 A * 7/1998 Jessup et al. ..... 428/73
5,846,357 A * 12/1998 Meteer et al. ..... 156/77
6,039,832 A * 3/2000 McCarville ..... 156/292
6,565,942 B2 * 5/2003 Anderson et al. ..... 428/73
6,945,111 B2 * 9/2005 Georgeson ..... 73/600
7,296,656 B2 * 11/2007 Sanicki et al. ..... 181/210
7,328,771 B2 * 2/2008 Costa et al. ..... 181/214
2007/0267246 A1 * 11/2007 Ali et al. ..... 181/214

OTHER PUBLICATIONS

Wikipedia Page, Syntactic Foam, http://en.wikipedia.org/wiki/Syntactic_foam.*

Non-Autoclave (Prepreg) Manufacturing Technology, Sep. 9, 2008, The Boeing Company.*

* cited by examiner

*Primary Examiner* — Jeremy Luks
(74) *Attorney, Agent, or Firm* — Hovey Williams LLP

(57) ABSTRACT

A method for splicing honeycomb core together to form a core structure, such as an acoustic panel for an aircraft. The core structure may comprise a first honeycomb core, a second honeycomb core, and an intermediate bonding part disposed between the first and second honeycomb cores. The intermediate bonding part may comprise a syntactic core wrapped with or sandwiched between a non-foaming film adhesive. The syntactic core sandwiched between a first and second layer of film adhesive and a first and second honeycomb core is then compressed by vacuum and cured to bond the honeycomb cores together, forming the core structure.

20 Claims, 3 Drawing Sheets

METHOD FOR BONDING HONEYCOMB CORES

BACKGROUND

1. Field

The present invention relates to a method for bonding honeycomb cores together using a syntactic core and non-foaming film adhesive.

2. Related Art

Honeycomb cores made of composite material, metals, or any combination thereof are often used in the construction of aircraft parts. For example, honeycomb cores are used to make acoustic panels in a nacelle for attenuating engine noise. Because of the large size of aircraft acoustic panels, it is usually necessary to splice multiple honeycomb cores together to form a single acoustic panel or core structure. Furthermore, to create acoustic panels of a desired shape and contour, a plurality of honeycomb cores are often spliced together.

Prior art methods of splicing honeycomb cores use various foam adhesives to bond the honeycomb cores together. However, the foam adhesive can overexpand at various locations during curing or heating, causing gaps between the adhesive and/or the honeycomb cores. This overexpansion can necessitate rework and repair of the spliced core assemblies, which can increase labor costs.

Furthermore, the thickness of the bondline formed by the foam adhesive adversely affects the acoustic performance of the acoustic panel. Sound waves bounce off of this bondline back into the nacelle and then out through the inlet, instead of being absorbed by the acoustic panel.

Accordingly, there is a need for an improved method for splicing honeycomb core together.

SUMMARY

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

The present invention solves some of the above-described problems and provides a distinct advance in the art of splicing honeycomb cores together to form a core structure, such as an acoustic panel. A core structure of one embodiment of the invention may comprise a first honeycomb core, a second honeycomb core, and an intermediate bonding part disposed between the first and second honeycomb cores. The intermediate bonding part may comprise a syntactic core wrapped with or sandwiched between a first layer and a second layer of non-foaming film adhesive.

The honeycomb cores may each comprise peripheral walls, a first end, and a second end. According to various embodiments of the invention, the intermediate structure is sandwiched between at least one peripheral wall of the first honeycomb core and at least one peripheral wall of the second honeycomb core. Then an impermeable membrane may be sealed around the core structure, with air removed therefrom such that the impermeable membrane compresses the core structure. The core structure being compressed by the impermeable membrane may then be cured by heat in an autoclave at a predetermined temperature for a predetermined length of time. Following the cure cycle in the autoclave, the core structure is removed, cools, and consequently hardens.

BRIEF DESCRIPTION OF THE DRAWINGS

Embodiments of the present invention are described in detail below with reference to the attached drawing figures, wherein.

Figure 1:
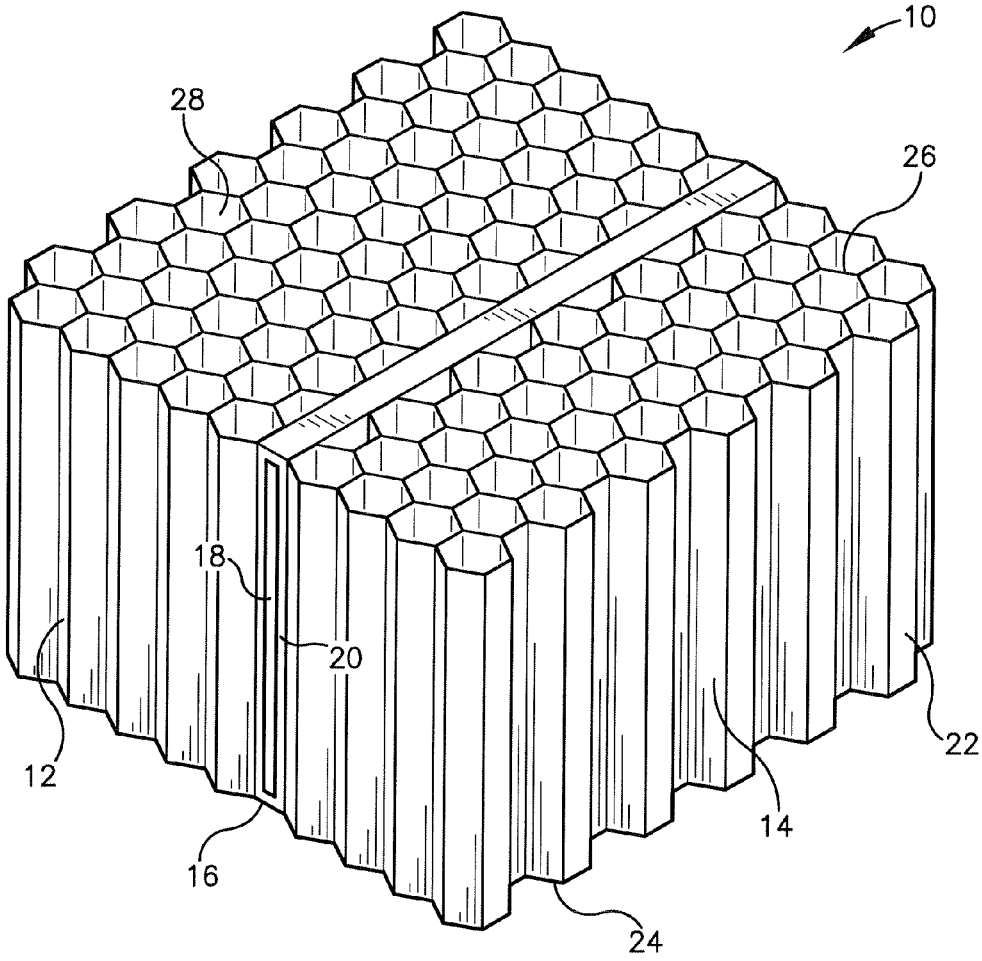
FIG. 1 is a perspective view of a core structure constructed according to an embodiment of the present invention.

The drawing figures do not limit the present invention to the specific embodiments disclosed and described herein. The drawings are not necessarily to scale, emphasis instead being placed upon clearly illustrating the principles of the invention.

DETAILED DESCRIPTION

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

Figure 2:
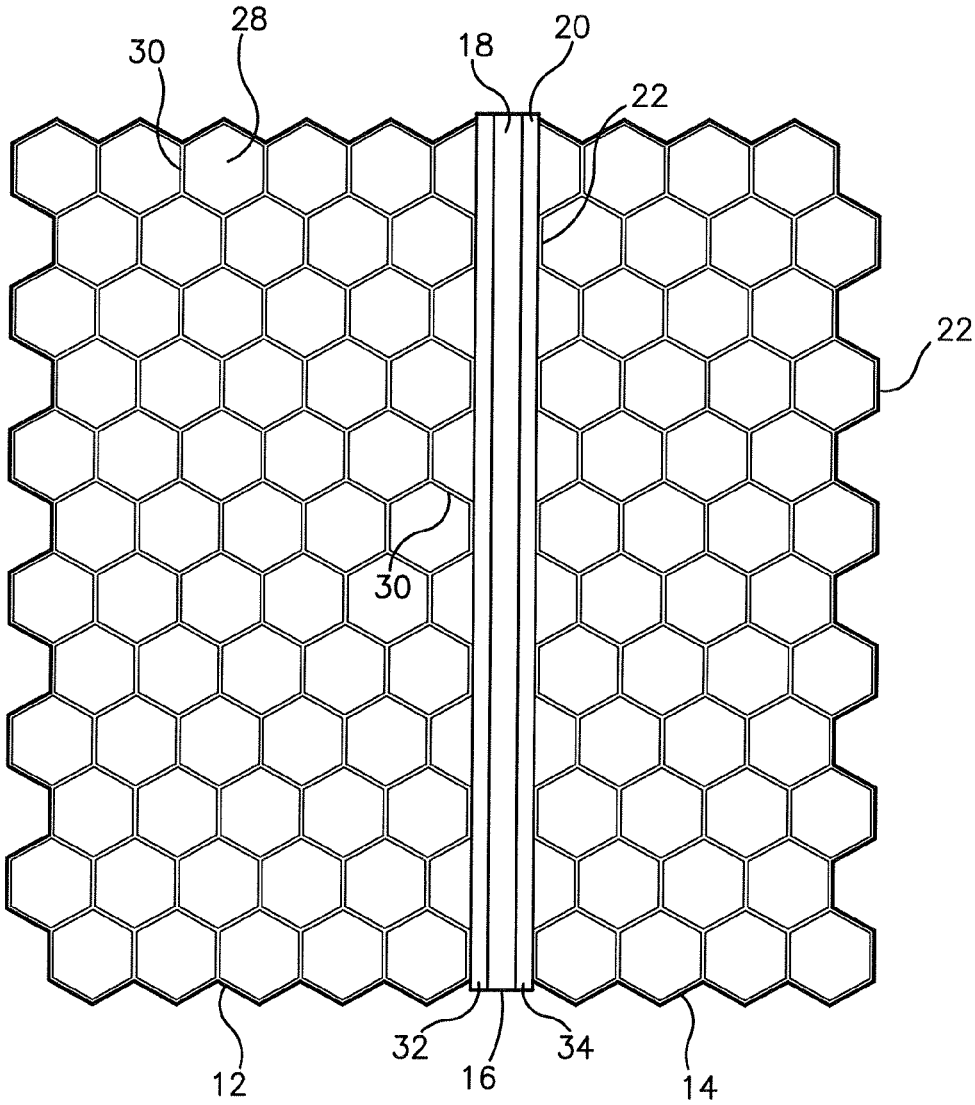
FIG. 2 is a top plan view of the core structure of FIG. 1.

Embodiments of the present invention are illustrated in FIGS. 1-2 and include a core structure 10 comprising a plurality of honeycomb cores 12,14 bonded together by at least one intermediate bonding part 16. The intermediate bonding part comprises a syntactic core 18 and a non-foaming film adhesive 20.

The honeycomb cores 12,14 may be formed of composite material, metal, combinations thereof, or any structural equivalents. Any number of honeycomb cores 12,14 may be bonded together in any configuration to form the core structure 10. For example, a first honeycomb core 12 may be bonded to a second honeycomb core 14, as described herein.

The honeycomb cores 12,14 may each comprise one or more peripheral walls 22, a first end 24, and a second end 26. In embodiments of the invention, a plurality of adjacent, hollow cells or compartments 28 are formed in each of the honeycomb cores 12,14, each bounded by one or more sidewalls 30 and open at the first end 24 and the second end 26 of its corresponding honeycomb core 12,14. The cells or compartments 28 may have hexagonal-shaped cross-sectional areas. Alternatively, the cells or compartments' cross-sectional area may have any two-dimensional shape. The peripheral walls 22 of the honeycomb cores 12,14 may comprise one or more of the sidewalls 30 bounding one or more of the cells or compartments 28. To form the core structure 10, at least one peripheral wall 22 of the first honeycomb core 12 may be bonded to at least one peripheral wall 22 of the second honeycomb core 14, as described herein.

The syntactic core 18 may be a composite material synthesized by filling a metal, polymer, or ceramic matrix with hollow, substantially spherical balls or particles, also referred to herein as hollow balls or microballoons. An example of syntactic core 18 is epoxy syntactic core FM381 produced by Cytec Industries, Inc. of Woodland Park, N.J. The syntactic core 18 does not expand when heated to typical cure temperatures, such as approximately 350 degrees Fahrenheit, and may be substantially malleable and taffy-like prior to being cured, as described below. In some embodiments of the invention, the syntactic core 18 may be between 0.01 and 0.03 inches thick. For example, the syntactic core 18 may be approximately 0.03 inches thick.

The non-foaming film adhesive 20 may be wrapped around and/or placed on two or more sides of the syntactic core 18. For example, the film adhesive 20 may comprise one or more layers 32,34 of the film adhesive 20, such as a first layer 32 on one side of the syntactic core 18 and a second layer 34 on an opposite side of the syntactic core 18, as illustrated in FIG. 2. An example of film adhesive 20 is FM377S produced by Cytec Industries, Inc. Of Woodland Park, N.J. In some embodiments of the invention, the film adhesive 20 may be between 0.001 and 0.01 inches thick. For example, the film adhesive 20 may be approximately 0.007 inches thick.

In various embodiments of the invention, the intermediate part 16 is less than approximately 0.05 inches. For example, the combined thickness of the syntactic core 18, first layer 32 of film adhesive 20, and second layer 34 of film adhesive 20 may be between 0.01 inches and 0.03 inches, although other thicknesses may be used. The thickness of the intermediate part 16 is ideally thin enough to minimize acoustic distortion (bouncing sound waves back into an aircraft inlet), but thick enough to provide a secure bond between the first and second honeycomb cores 12,14.

A method performed according to various embodiments of the present invention includes covering the syntactic core 18 with the film adhesive 20 and sandwiching the resulting intermediate bonding part 16 between the first honeycomb core 12 and the second honeycomb core 14. Then the resulting core structure may be vacuum bagged and cured, as described below.

Figure 3:
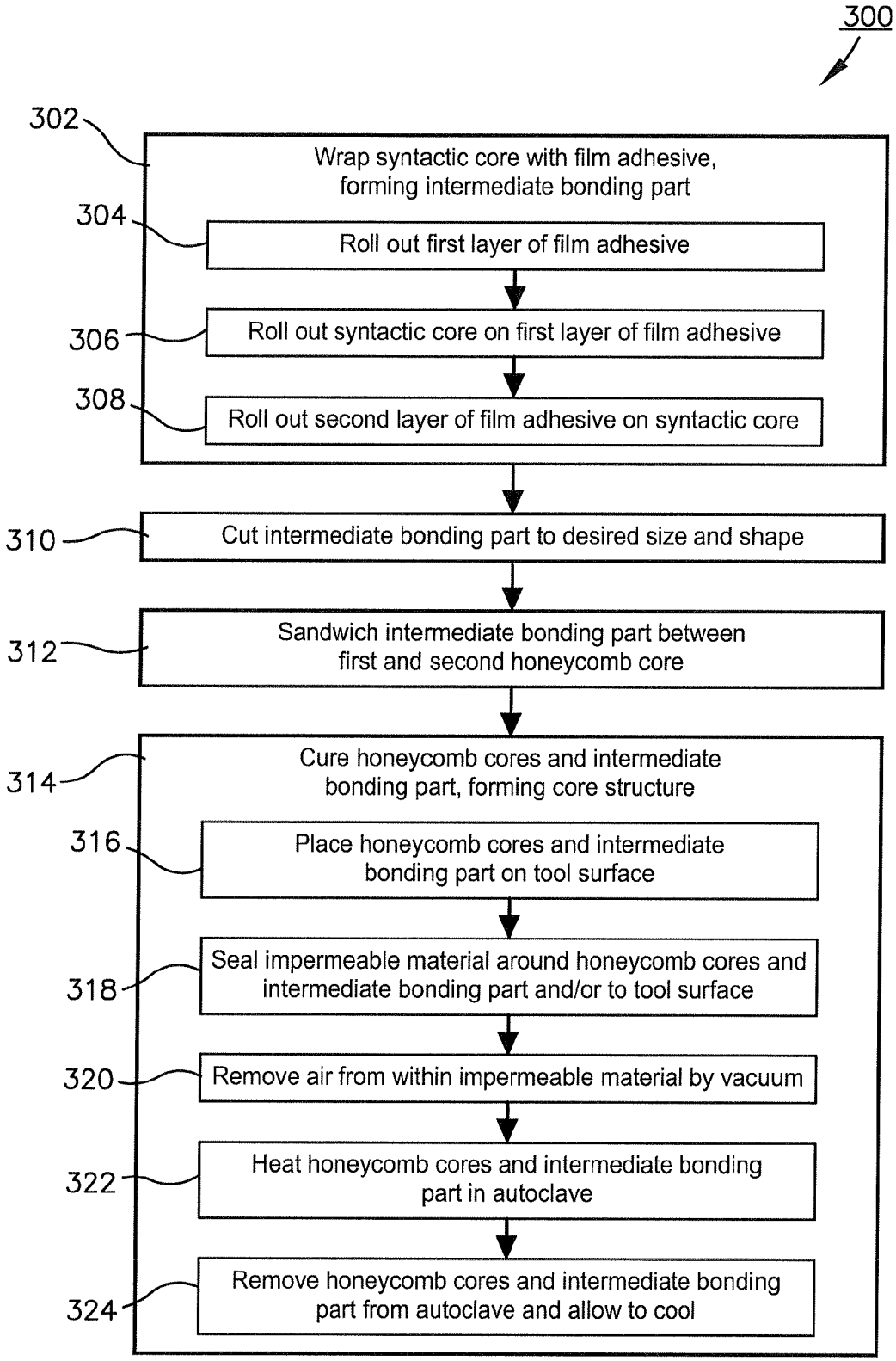
FIG. 3 is a flow chart of a method of bonding two honeycomb cores together according to an embodiment of the present invention.

The flow chart of FIG. 3 depicts the steps of exemplary methods of the invention in more detail. In some alternative implementations, the functions noted in the various blocks may occur out of the order depicted in FIG. 3. For example, two blocks shown in succession in FIG. 3 may in fact be executed substantially concurrently, or the blocks may sometimes be executed in the reverse order depending upon the functionality involved.

The method 300, as illustrated in FIG. 3, may comprise wrapping one or more sides of the syntactic core 18 with the film adhesive 20 to form the intermediate bonding part 16, as depicted in step 302. An exemplary method of performing step 302 includes rolling out the first layer 32 of the film adhesive 20, as depicted in step 304, and removing a backing attached thereto. The backing (not shown) may be configured for preventing the first layer 32 from sticking to itself when stored or transported by its manufacturer. Then the syntactic core 18 may be rolled out on top of the first layer 32, as depicted in step 306, and the syntactic core's corresponding backing may also be removed. Next, the second layer 34 of the film adhesive 20 may be rolled out on top of the syntactic core 18, as depicted in step 308, and the second layer's corresponding backing may also be removed.

The method 300 may also comprise cutting the intermediate bonding part 16, as depicted in step 310, to a desired size, shape, and/or area depending on a desired area of the honeycomb cores 12,14 to be bonded together. Then, as depicted in step 312, the method may comprise sandwiching the intermediate bonding part 16 between the first and second honeycomb cores 12,14 to form the core structure 10. The intermediate bonding part 16 may be placed against at least one of the peripheral walls 22 of the first honeycomb core 12 and against at least one of the peripheral walls 22 of the second honeycomb core 14.

Next, the core structure 10 may be cured, as depicted in step 314. In an exemplary embodiment of the invention, curing the core structure may comprise placing the core structure onto a tool surface (not shown), as depicted in step 316. Then the curing step may comprise sealing a malleable, impermeable material, such as a vacuum bag, around the core structure 10 and/or to the tool surface, as depicted in step 318. As depicted in step 320, air may be removed from within the impermeable material and/or between the impermeable material and the tool surface to compress the first and second honeycomb cores 12,14 toward each other and into the intermediate bonding part 16.

Once the core structure 10 is compressed under vacuum, it may be heated in an autoclave, as depicted in step 322, for a predetermined time at a predetermined temperature. For example, the core structure under vacuum may be heated at a temperature of approximately 350 degrees. Once the predetermined amount of time has passed, the core structure 20 may be removed from the autoclave, as depicted in step 324, and allowed to cool. This curing process causes the syntactic core 18 to harden and bonds the first honeycomb core 12 to the second honeycomb core 14.

Although the invention has been described with reference to the embodiments illustrated in the attached drawing figures, it is noted that equivalents may be employed and substitutions made herein without departing from the scope of the invention as recited in the claims.

The invention claimed is:

1. A method for bonding a honeycomb core to form a core structure, the method comprising:

covering at least two sides of a syntactic core with non-foaming film adhesive, thereby forming an intermediate bonding part, wherein the syntactic core is configured to not expand during autoclave curing;

sandwiching the intermediate bonding part between two honeycomb cores;

curing the intermediate bonding part and honeycomb cores, thereby forming a core structure.

2. The method of claim 1, wherein the step of curing includes:

sealing an impermeable membrane around at least a portion of the honeycomb cores and removing air therefrom, causing the impermeable membrane to compress the honeycomb cores toward each other; and heating the intermediate bonding part and the two honeycomb cores compressed by the impermeable membrane in an autoclave for a predetermined length of time at a predetermined temperature.

3. The method of claim 1, wherein the honeycomb cores are comprised of at least one of composite material and metal.

4. The method of claim 1, wherein the syntactic core is epoxy syntactic core FM381.

5. The method of claim 1, wherein the film adhesive is between 0.001 inches and 0.01 inches thick.

6. The method of claim 1, wherein the syntactic core is between 0.01 inches thick and 0.03 inches thick.

7. The method of claim 1, wherein the syntactic core and film adhesive is sandwiched between peripheral walls of the honeycomb cores.

8. The method of claim 1, wherein the combined thickness of the syntactic core, first layer of film adhesive, and second layer of film adhesive is less than 0.05 inches.

9. A method for splicing honeycomb core to form a core structure, the method comprising:

sandwiching a syntactic core between a first and second layer of non-foaming film adhesive, thereby forming an intermediate bonding part, wherein the syntactic core is configured to liquify during autoclave curing;

sandwiching the intermediate bonding part between one or more peripheral walls of the two honeycomb cores;

curing the intermediate bonding part and honeycomb cores; and cooling the intermediate bonding part and honeycomb cores, thereby hardening the resulting core structure.

10. The method of claim 9, wherein the step of curing includes:

sealing an impermeable membrane around at least a portion of the honeycomb cores and removing air therefrom, causing the impermeable membrane to compress the honeycomb cores toward each other; and heating the intermediate bonding part and the two honeycomb cores compressed by the impermeable membrane in an autoclave for a predetermined length of time at a predetermined temperature.

11. The method of claim 9, wherein the honeycomb cores are comprised of at least one of composite material and metal.

12. The method of claim 9, wherein the syntactic core is epoxy syntactic core FM381.

13. The method of claim 9, wherein the film adhesive is between 0.001 inches and 0.01 inches thick.

14. The method of claim 9, wherein the syntactic core is between 0.01 inches thick and 0.03 inches thick.

15. The method of claim 9, wherein the thickness of the intermediate bonding part is less than 0.05 inches.

16. An acoustic panel for an aircraft nacelle, the acoustic panel comprising:

an intermediate bonding part, including:

a syntactic core configured to liquify during autoclave curing, and a non-foaming film adhesive covering at least two opposing sides of the syntactic core;

a first honeycomb core having one or more peripheral walls; and a second honeycomb core having one or more peripheral walls, wherein the intermediate bonding part is sandwiched between peripheral walls of the first and second honeycomb cores and bonded thereto by way of autoclave curing.

17. The acoustic panel of claim 16, wherein the honeycomb cores are comprised of at least one of composite material and metal.

18. The acoustic panel of claim 16, wherein the syntactic core is epoxy syntactic core FM381.

19. The acoustic panel of claim 16, wherein the honeycomb cores comprise a plurality of hollow compartments each having a hexagonal-shaped cross-sectional area.

20. The acoustic panel of claim 16, wherein the non-foaming film adhesive is FM377S.

* * * * *